US007093539B2

(12) United States Patent
Luckhardt et al.

(10) Patent No.: US 7,093,539 B2
(45) Date of Patent: Aug. 22, 2006

(54) PRINTING MACHINE

(75) Inventors: Ulrich Luckhardt, Heidelberg (DE); Mathias Zuber, Helmstadt-Bargen (DE)

(73) Assignee: Heidelberger Drucksmaschinen AG, Heidelberg (DE)

( * ) Notice: Subject to any disclaimer, the term of this patent is extended or adjusted under 35 U.S.C. 154(b) by 0 days.

(21) Appl. No.: 11/212,403

(22) Filed: Aug. 25, 2005

(65) Prior Publication Data

US 2006/0042484 A1 Mar. 2, 2006

(30) Foreign Application Priority Data

Aug. 25, 2004 (DE) ..... 10 2004 041 150

(51) Int. Cl.
*B41F 7/26* (2006.01)
*B41F 7/24* (2006.01)

(52) U.S. Cl. ..... 101/147; 101/148

(58) Field of Classification Search ..... 101/147
See application file for complete search history.

(56) References Cited

U.S. PATENT DOCUMENTS 4,621,574 A 11/1986 Faddis et al.
5,003,871 A 4/1991 Franz et al.
5,435,243 A 7/1995 Makino et al.
6,460,455 B1 10/2002 Eltner et al.

FOREIGN PATENT DOCUMENTS

| | | |
|---|---|---|
| DE | 34 34 647 A1 | 4/1986 |
| DE | 35 39 254 A1 | 10/1986 |
| DE | 87 16 847.2 U1 | 3/1988 |
| DE | 37 06 602 A1 | 9/1988 |
| DE | 694 20 996 T2 | 10/1994 |
| DE | 195 01 146 C1 | 4/1996 |
| DE | 199 11 568 A1 | 9/2000 |
| GB | 2 297 062 A | 7/1996 |
| JP | 7-266534 | 10/1995 |
| WO | 2004/054804 A1 | 7/2004 |

*Primary Examiner*—Andrew H. Hirshfeld
*Assistant Examiner*—Joshua Zimmerman
(74) *Attorney, Agent, or Firm*—Laurence A. Greenberg; Werner H. Stemer; Ralph E. Locher

(57) ABSTRACT

A printing machine includes a printing form cylinder, a first roller, a second roller, a third roller, a fourth roller, and a dampener roller. The machine has a defined roller control position, wherein the first roller engages with the dampener roller, the third roller and the fourth roller, the second roller engages with the dampener roller, and the dampener roller engages with the printing form cylinder. In this same roller position, the second roller further engages with the third roller.

10 Claims, 3 Drawing Sheets

PRINTING MACHINE

BACKGROUND OF THE INVENTION

Field of the Invention

The invention relates to a printing machine having a printing plate or printing form cylinder, a first roller, a second roller, a third roller, a fourth roller and a dampener roller. In a roller control position of the printing machine, the first roller rests against or engages with the dampener roller, the third roller and the fourth roller, the second roller engages with the dampener roller, and the dampener roller engages with the plate or form cylinder.

According to published German patent application DE 199 11 568 A1 (corresponding to U.S. Pat. No. 6,460,455), which forms the closest prior art, the second roller engages solely with the dampener roller. In hindsight, however, it has been noted that such a roller configuration remains in need of improvement, on the one hand, with regard to the distribution of varying emulsion concentrations on the dampener roller and, on the other hand, with regard to a rapid adjustment of a stable balance or equilibrium between the dampening medium and the printing ink in the inking unit.

According to German patent 195 01 146, which forms more distant prior art, the first roller only engages with the dampener roller and the third roller.

Even more distant prior art is represented by German patent 34 34 647, published German patent application DE 37 06 602 A1 (corresponding to U.S. Pat. No. 5,003,871) and German Petty Patent (Gebrauchsmuster) DE 87 16 847 U1.

SUMMARY OF THE INVENTION

It is accordingly an object of the invention to provide a printing machine of the aforementioned type having an improved or more efficient distribution of the emulsion concentrations on the dampener roller.

With the foregoing and other objects in view, there is provided, in accordance with the invention, a printing machine comprising a printing form cylinder, a first roller, a second roller, a third roller, a fourth roller and a dampener roller; in a roller control position of the printing machine, the first roller engaging with the dampener roller, the third roller and the fourth roller, the second roller engaging with the dampener roller, and the dampener roller engaging with the printing form cylinder, and further comprising, in the roller control position, also the second roller engaging with the third roller.

In accordance with another feature of the invention, in the roller control position, the third roller engages exclusively with the first roller and the second roller.

In accordance with a further feature of the invention, in the roller control position, the third roller engages with the fifth roller.

In accordance with an added feature of the invention, the fifth roller is an oscillating ink distributor roller.

In accordance with an additional feature of the invention, the printing machine further comprises a gearwheel arranged coaxially with the fifth roller for rotatively driving the fifth roller.

In accordance with yet another feature of the invention, the first roller is an oscillating ink distributor roller.

In accordance with yet a further feature of the invention, the printing machine further comprises a gearwheel arranged coaxially with the first roller for rotatively driving the first roller.

In accordance with a concomitant feature of the invention, the fourth roller is an inking roller engaging with the printing form cylinder in the roller control position.

Accordingly, the printing machine according to the invention includes a plate or form cylinder, a first roller, a second roller, a third roller, a fourth roller and a dampener roller. In addition, the rollers of the printing machine according to the invention are mounted so as to configure a roller control position wherein the first roller rests against or engages with the dampener roller, the third roller and the fourth roller and, thus, engages simultaneously with the three different rollers. Furthermore, the roller control position of the printing machine is also unique because, in this roller position, the second roller engages with the dampener roller, and the dampener roller engages with the plate or printing form cylinder. The special feature of this roller control position is that, in addition to the first roller, the second roller, as well, engages with the third roller. Thus, in the aforementioned roller position, both of the rollers, namely the first roller and the second roller, engage with both the dampener roller and the third roller, simultaneously.

For the purpose of configuring the roller control position, it is not urgently required to displace each of the aforementioned rollers. For example, the first roller can be mounted in a fixed position so that it does not get displaced while adjusting the roller control position. For example, the dampener roller can be mounted so as to be engageable with and disengageable from the printing plate or printing form cylinder, whereby, for the purpose of adjusting the roller control position, the dampener roller is engaged with the plate or form cylinder. If several rollers are displaced for adjusting the roller control position, these roller adjustments can be performed simultaneously or in succession.

An additional advantage of the printing machine pursuant to the invention is that the stable balance or equilibrium of the printing ink and the dampening solution in the inking unit can be adjusted in a particularly rapid manner.

Further advantageous embodiments of the printing machine or press according to the invention are explained briefly hereinbelow.

Thus, in another embodiment of the printing machine according to the invention, the roller control position is such that the third roller does not engage with any other roller other than the first roller and the second roller.

In a further embodiment of the invention, the roller control position is such that the third roller not only engages with the first roller and the second roller, but also simultaneously with a fifth roller.

In an added embodiment of the invention, this fifth roller is an axially reciprocatingly movable ink distributor roller.

In an additional embodiment of the invention, the fifth roller and a gearwheel are arranged coaxially with one another so that the fifth roller can be rotatively driven via the gearwheel. The fifth roller is thus driven rotatively in a form-locking or positive manner.

In yet another embodiment of the invention, the first roller is an axially reciprocatingly movable ink distributor roller.

In yet a further embodiment of the invention, a gearwheel is arranged coaxially with the first roller via which the first roller is driven rotatively. Accordingly, the gearwheel enables a form-locking or positive rotation drive of the first roller.

In yet an added embodiment of the invention, the fourth roller is an ink form roller and engages with the plate or form cylinder in the aforementioned roller control position.

Other features which are considered as characteristic for the invention are set forth in the appended claims.

Although the invention is illustrated and described herein as embodied in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

In FIGS. 1 to 6, similar components are identified by identical reference numerals.

DESCRIPTION OF THE PREFERRED EMBODIMENTS

Figure 1:
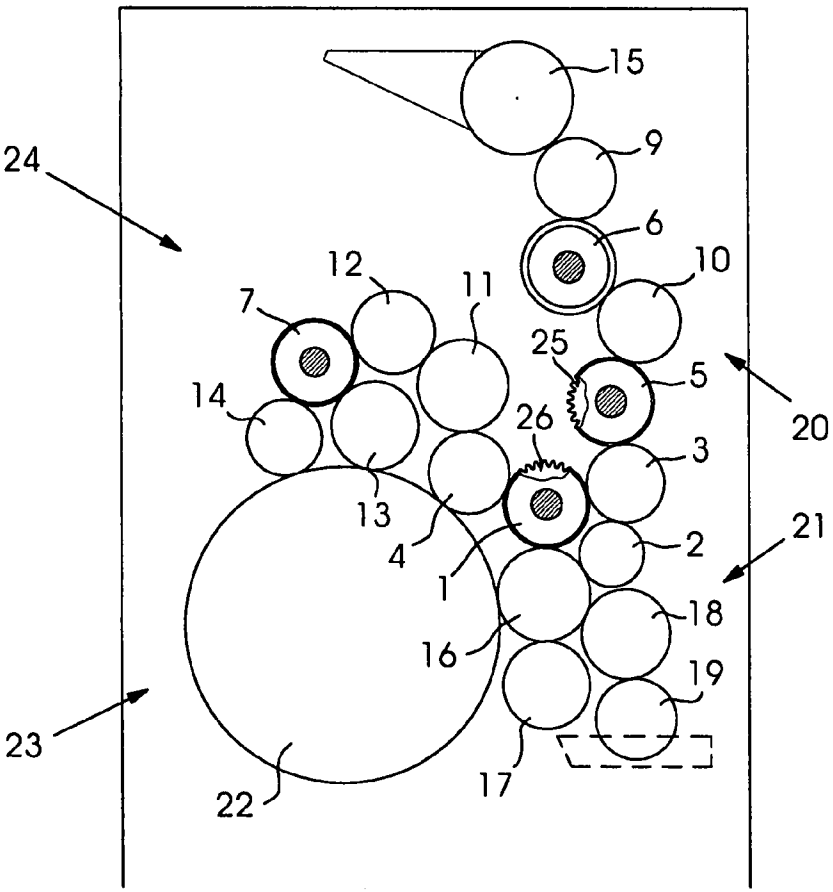

Referring now to the drawings and, first, particularly to FIG. 1 thereof, there is illustrated therein a printing machine 24 with an offset printing unit 23 having a printing form or plate cylinder 22, an inking unit 20 and a dampening unit 21.

In a first roller position for the printing operation illustrated in FIG. 1, the inking unit 20 and the dampening unit 21 are connected to one another via a first roller 1 and a second roller 2. The first roller 1 is a first ink distributor roller, and the second roller 2 is a first transfer roller. Furthermore, the inking unit 20 has a third roller 3 and a fourth roller 4. The third roller 3 is a second transfer roller, and the fourth roller 4 is a first ink form roller. Moreover, the inking unit 20 also has a fifth roller 5 as a second ink distributor roller, a third ink distributor roller 6 and a fourth ink distributor roller 7.

Each ink distributor roller 1. 5, 6 or 7 is driven rotationally in a form-locking or positive manner, as has been illustrated by way of example by a gearwheel 26 connected with the first roller 1 in a torque-proof manner, and a gearwheel 25 connected with the second ink distributor roller 5 in a torque-proof manner. Also, the axial changing movement of each ink distributor roller 1, 5, 6 or 7 is driven in a form-locking or positive manner and not with a friction fit.

The inking unit 20 has a third transfer roller 10, a fourth transfer roller 11 and a fifth transfer roller 12. In the first roller position that is illustrated in FIG. 1, each transfer roller 2, 3, 10, 11 or 12 engages simultaneously with at least two adjacent rollers. Furthermore, the inking unit 20 has an ink fountain or duct roller 15, a ductor or vibrator roller 9, a second ink form roller 13 and a third ink form roller 14.

The dampening unit 21 has a dampener roller 16, a dip or pan roller 19, a metering roller 18 which, in the first roller position, simultaneously engages, as a transfer roller, with the dampener roller 16 and the dipping roller 19, and a dampener distributor roller 17 engaging permanently, i.e., in every roller position, and solely with the dampener roller 16. Both the rotation of the dampener distributor roller 17 as well as the changing movement thereof is driven in a form-locking or positive manner. The ink form rollers 4, 13, 14 and 16 which are in the first roller control position, engage with the printing form cylinder 22, and the transfer rollers 2, 3, 10, 11 and 12, respectively, have a rubber-elastic peripheral surface and are, respectively, rotatively driven solely via the friction between the peripheral surfaces. The first roller 1 engages permanently with two adjacent rollers simultaneously, namely with the dampener roller 16 and with the third roller 3. The second roller 2 permanently engages the dampener roller 16.

Figure 2:
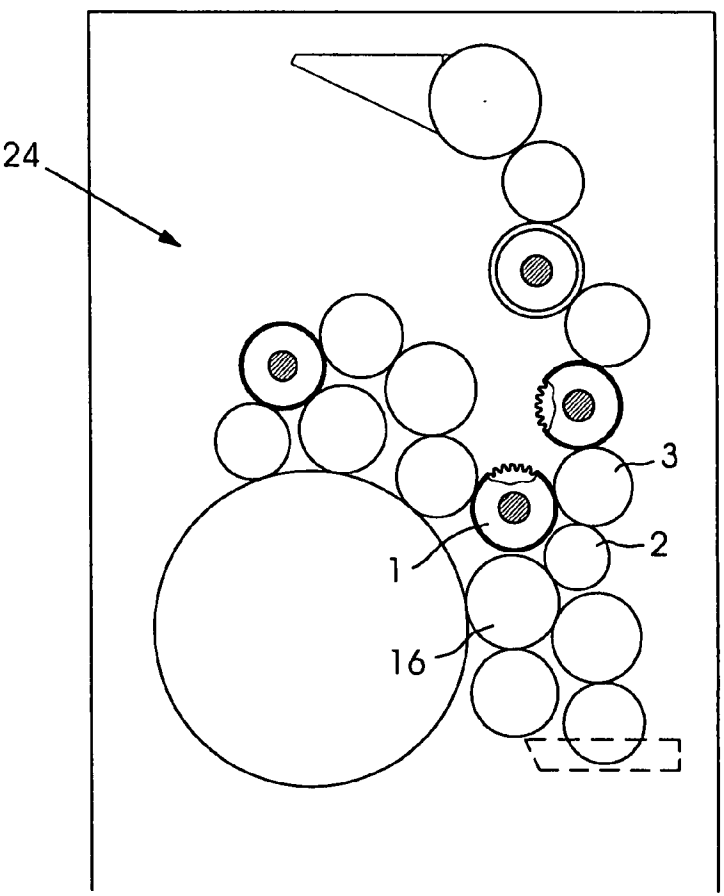
FIGS. 1 to 4 are diagrammatic side elevational views of a first embodiment of the printing machine according to the invention illustrating a roller control position wherein the third roller engages with the fifth roller.
Figure 3:
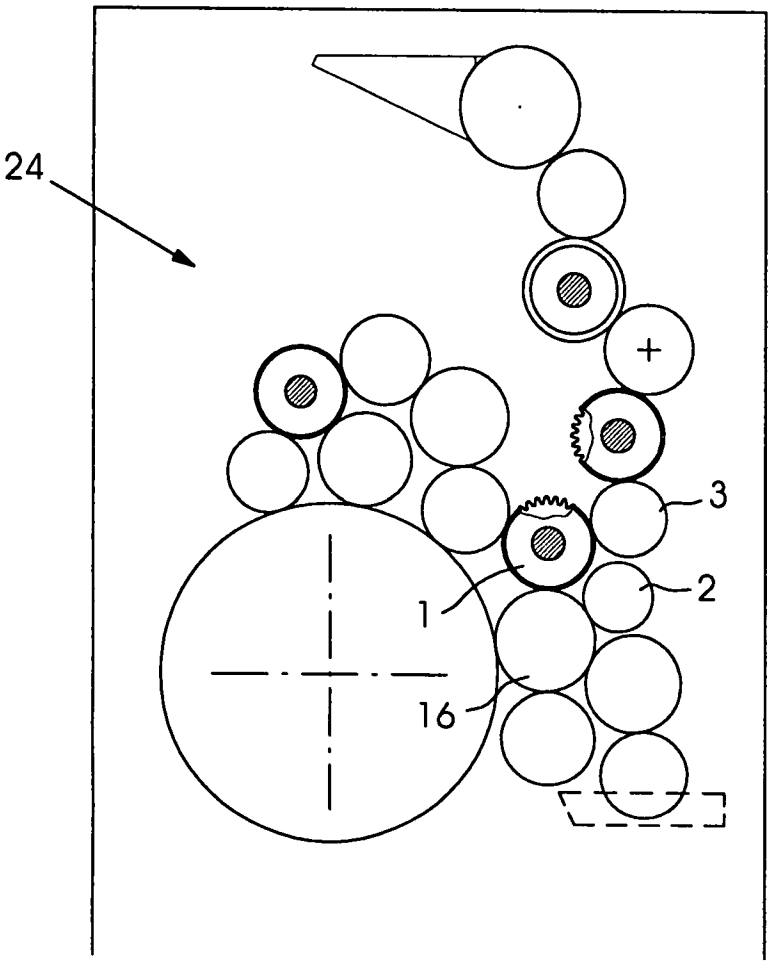

In the first roller control position and in a second roller control position for the printing operation, which is illustrated in FIG. 2, the second roller 2 not only engages with the dampener roller 16 but simultaneously also with the third roller 3. In the first roller control position and in a third roller control position for the printing operation illustrated in FIG. 3, the first roller 1 engages simultaneously with three adjacent rollers, namely with the dampener roller 16, the third roller 3 and additionally the fourth roller 4.

The particular distinctive feature of the first roller control position illustrated in FIG. 1 is the coupling of the third roller 3 and, consequently, the inking unit 20 via two parallel-disposed rollers, namely the first roller 1 and the second roller 2, with the dampener roller 16 and thus with the dampening unit 21 for forming a so-called inking and dampening unit. In this regard, the first roller 1 and the second roller 2 are arranged as so-called bypass rollers between the third roller 3, which is an inking unit roller, and the dampener roller 16, which is a dampening unit roller.

The dampening unit 21 can be switched over from the first roller control position (note FIG. 1) into the second roller control position (note FIG. 2) wherein the dampener roller 16 is disengaged from the first roller 1. The dampening unit 21 can also be switched over from the first roller control position (note FIG. 1) into the third roller control position (note FIG. 3) wherein the second roller 2 is disengaged from the third roller 3.

Figure 4:
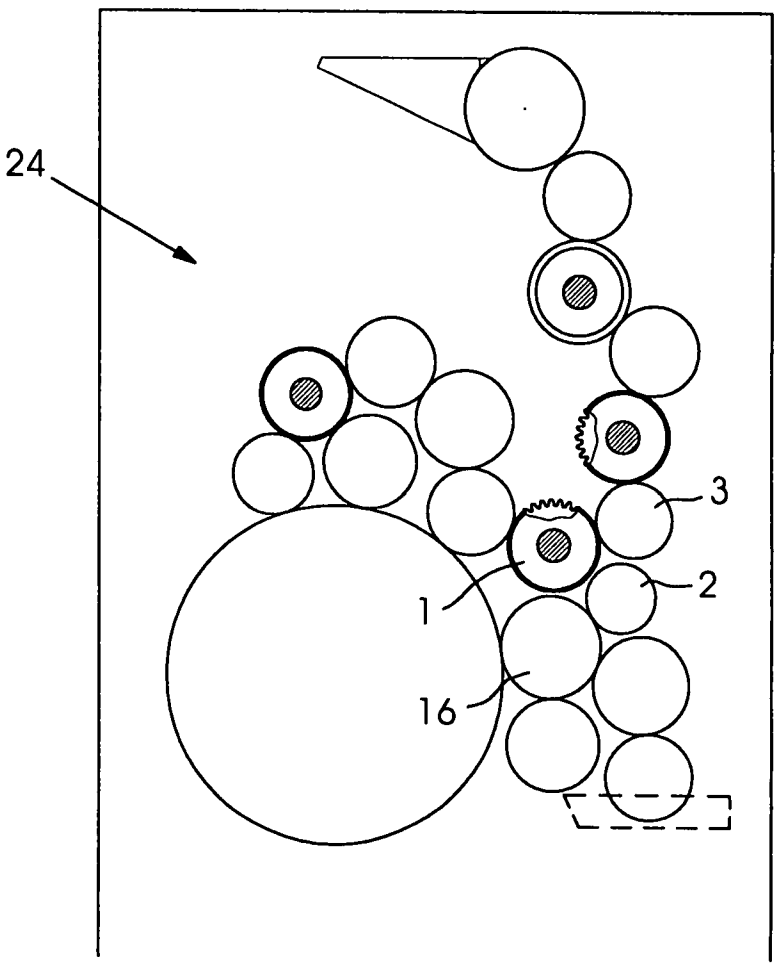

FIG. 4 illustrates a fourth roller control position for the printing operation which is selectively adjustable just like the other roller control positions depending upon the requirements of the respective print job, wherein the dampening unit 21 is decoupled from the inking unit 20. In this fourth roller control position, the dampener roller 16 is disengaged from the first roller 1, and the second roller 2 is disengaged from the third roller 3.

Figure 5:
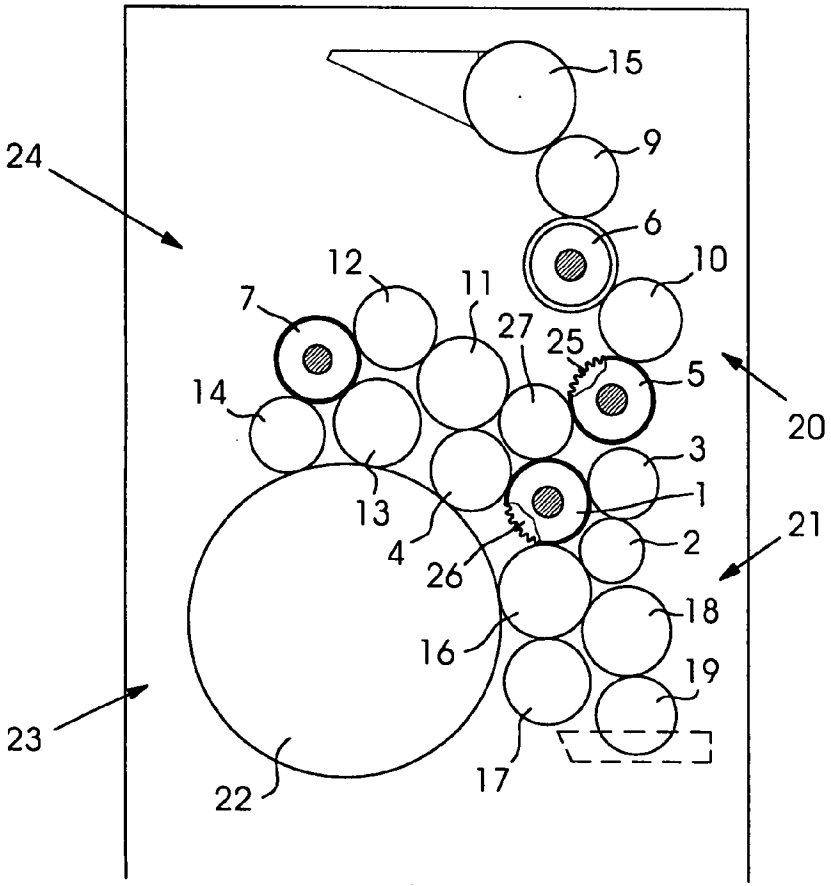
FIG. 5 is a diagrammatic side elevational view of a second embodiment of the printing machine according to the invention illustrating a roller control position wherein the third roller engages solely with the first roller and the second roller.

FIG. 5 illustrates a second embodiment of the printing machine 24 which is identical to the first embodiment except for the differences noted hereinbelow. In the second embodiment of the invention, the printing machine 24 has only one roller control position for the printing operation that is graphically illustrated in FIG. 5 and one or more other roller control positions for different operational modes of the printing operation such as, for example, for interruption in printing and for a so-called pre-dampening process. In the second embodiment of the invention, the third roller 3 does indeed engage with the first roller 1 and the second roller 2, as is the case even in the first embodiment, however, it does not engage with the fifth roller 5. A sixth transfer roller 27 engages with the fifth roller 5. The sixth transfer roller 27 also engages with the first roller 1 and the fourth transfer roller 11. Thus, it engages simultaneously with three adjacent rollers, namely with the first roller 1, the fifth roller 5 and the fourth transfer roller 11.

Figure 6:
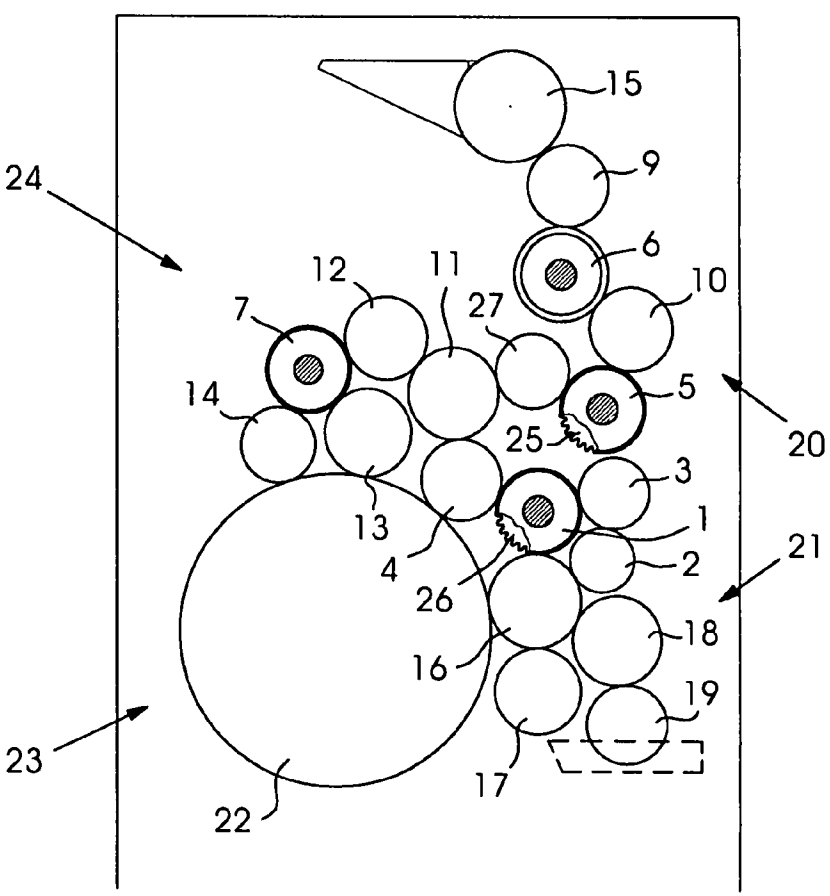
FIG. 6 is a diagrammatic side elevational view of a third embodiment of the printing machine according to the invention illustrating a roller control position which is a modification of the roller control position for the second embodiment shown in FIG. 5.

FIG. 6 illustrates a third embodiment of the printing machine 24 which differs from the second embodiment (note FIG. 5) only in that the sixth transfer roller 27 no longer engages with the first roller 1. However, in the third embodiment of the invention, the sixth transfer roller 27 engages, as before, with the fifth roller 5 and simultaneously with the fourth transfer roller 11.

This application claims the priority, under 35 U.S.C. § 119, of German patent application No. 10 2004 041 150.6, filed Aug. 25, 2004; the entire disclosure of the prior application is herewith incorporated by reference.

We claim:

1. A printing machine comprising:

a printing form cylinder;

a first roller, a second roller, a third roller, and a fourth roller, said second roller being rotatively driven solely by peripheral surface friction; and a dampener roller;

in a roller control position of the printing machine, said first roller engaging with said dampener roller, with said third roller and with said fourth roller, said second roller engaging with said dampener roller and with said third roller, and said dampener roller engaging with said printing form cylinder.

2. The printing machine according to claim 1, wherein, in the roller control position, said third roller engages exclusively with said first roller and said second roller.

3. The printing machine according to claim 1, wherein, in the roller control position, said third roller engages with a fifth roller.

4. The printing machine according to claim 3, wherein said fifth roller is an oscillating ink distributor roller.

5. The printing machine according to claim 3, further comprising a gearwheel disposed coaxially with said fifth roller for rotatively driving said fifth roller.

6. The printing machine according to claim 1, wherein said first roller is an oscillating ink distributor roller.

7. The printing machine according to claim 1, further comprising a gearwheel disposed coaxially with said first roller for rotatively driving said first roller.

8. The printing machine according to claim 1, wherein said fourth roller is an inking roller engaging with said printing form cylinder in the roller control position.

9. The printing machine according to claim 1, wherein said second roller has a rubber-elastic peripheral surface.

10. A printing machine comprising:

a printing form cylinder;

a first roller, a second roller, a third roller, a fourth roller, and a fifth roller; and a dampener roller;

in a roller control position of the printing machine, said first roller engaging with said dampener roller, with said third roller and with said fourth roller, said second roller engaging with said dampener roller and with said third roller, said third roller engaging with said fifth roller, and said dampener roller engaging with said printing form cylinder.

* * * * *